US008359725B1

(12) United States Patent
Tauzer

(10) Patent No.: US 8,359,725 B1
(45) Date of Patent: Jan. 29, 2013

(54) SINGLE ACTION SWAGE

(75) Inventor: Paul Jeffrey Tauzer, Auburn, WA (US)

(73) Assignee: The Boeing Company, Chicago, IL (US)

( * ) Notice: Subject to any disclaimer, the term of this patent is extended or adjusted under 35 U.S.C. 154(b) by 581 days.

(21) Appl. No.: 12/622,770

(22) Filed: Nov. 20, 2009

(51) Int. Cl.

| | |
|---|---|
| ***B23P 11/00*** | (2006.01) |
| ***B21D 39/00*** | (2006.01) |
| ***B21D 37/14*** | (2006.01) |
| ***B21D 39/20*** | (2006.01) |

(52) U.S. Cl. ..... 29/520; 29/507; 29/516; 29/523; 29/522.1; 29/282; 29/283.5; 72/58; 72/370.06; 72/370.08; 72/470; 72/471

(58) Field of Classification Search ..... 29/520, 29/505, 507, 516, 522.1, 523, 282, 283.5; 72/307.07, 370.08, 466.8, 370.06, 370.01, 72/370.04, 465.1, 466.9, 467, 469, 470, 471, 72/62, 58, 60, 370.07

See application file for complete search history.

(56) References Cited

U.S. PATENT DOCUMENTS

| | | | | |
|---|---|---|---|---|
| 3,200,628 | A * | 8/1965 | Palkowski et al. | 72/62 |
| 3,592,034 | A * | 7/1971 | McMeen et al. | 72/58 |
| 3,595,047 | A | 7/1971 | Morton et al. | |
| 3,661,004 | A * | 5/1972 | Lee et al. | 72/56 |
| 4,006,619 | A * | 2/1977 | Anderson | 72/54 |
| 4,043,160 | A * | 8/1977 | Baker et al. | 72/67 |
| 4,068,372 | A * | 1/1978 | Kamohara et al. | 29/727 |
| 4,320,568 | A * | 3/1982 | Herrod et al. | 29/421.1 |
| 4,343,170 | A * | 8/1982 | Hufton | 72/61 |
| 4,411,456 | A * | 10/1983 | Martin | 285/39 |
| 4,641,407 | A | 2/1987 | Blevins et al. | |
| 4,761,981 | A * | 8/1988 | Kelly | 29/421.1 |
| 4,985,975 | A * | 1/1991 | Austin et al. | 29/283.5 |
| 5,233,855 | A | 8/1993 | Maki et al. | |
| 7,065,995 | B2 * | 6/2006 | Frenken | 72/62 |
| 7,287,406 | B2 * | 10/2007 | Hwang | 72/58 |
| 2004/0107754 | A1 * | 6/2004 | Frenken | 72/62 |

* cited by examiner

*Primary Examiner* — Essama Omgba
(74) *Attorney, Agent, or Firm* — Yee & Associates, P.C.

(57) ABSTRACT

The different advantageous embodiments provide a method and apparatus for forming materials that may comprise a body having a channel and an insert. The channel may extend to a first opening in the body and a second opening in the body. The embodiments may also provide a mandrel disposed in the channel of the body and the insert of the body. The mandrel may have a shaft, a head on the shaft, and a compressible material disposed between the head and the insert of the body. The embodiments may also provide a collar. The collar may have a diameter smaller than a diameter of the body. The embodiments may also provide a biasing system configured to guide the collar in a first direction to a first position and then to a second position and configured to apply force to the body in a second direction.

27 Claims, 9 Drawing Sheets

SINGLE ACTION SWAGE

BACKGROUND INFORMATION

1. Field

The present disclosure relates generally to aircraft and, in particular, to a method and apparatus for swaging. Still, more particularly, the present disclosure relates to a method and apparatus for forming items.

2. Background

Swaging may be a forming process to attach tubing to the grooved inner circumferential surfaces of ferrules or connectors. This is achieved by roller swaging, mechanically swaging the tube material with internal rollers, or by elastomeric swaging, expanding tubes with a compressible elastomer.

Elastomeric swaging may be a process used to fasten end fittings or ferrules onto tubes of steel, aluminum, copper, or other deformable metals. Swaging may be commonly done by assembling an elastomeric sheath and a bushing onto a drawbolt with an expanded head portion. The drawbolt assembly may be positioned in a tube end which is inserted in a ferrule and placed in the swaging die. The drawbolt is pulled towards, or pushed against, the bushing, forcing the elastomeric sheath to compress and expand outward into the tube, forcing the tube into the grooves of the ferrule.

Accordingly, it would be advantageous to have a method and apparatus which takes into account one or more of the issues discussed above, as well as possibly other issues.

SUMMARY

The different advantageous embodiments may provide an apparatus comprising a body having a channel and an insert. The channel may extend to a first opening in the body and a second opening in the body. The apparatus may also comprise a mandrel disposed in the channel of the body and the insert of the body. The mandrel may have a shaft, a head on the shaft, and a compressible material disposed between the head and the insert of the body. The apparatus may also comprise a collar. The collar may have a diameter smaller than a diameter of the body. The apparatus may also comprise a biasing system configured to guide the collar in a first direction to a first position and then to a second position. The apparatus may further comprise a number of springs configured to apply force to the body in a second direction. The channel of the body may have a diameter that is configured to decrease in size. The mandrel may be configured to receive a tube from the head to the insert of the body. The first position may allow the collar to clamp the tube and a ferrule. The second position may allow the collar to compress the compressible material expanding a wall of the tube outward into grooves of the ferrule.

The different advantageous embodiments may provide a method for forming a tube and a ferrule together. The process may begin by positioning the tube in a channel through a first opening of the channel of a body over a head of a mandrel and against an insert of the body. A compressible material may be disposed between the head of the mandrel and the insert of the body. The ferrule may be positioned around the tube which is around the compressible material. A collar may be guided in a first direction around the body to a first position to move the body radially inward closing the channel around the insert and clamping the tube and the ferrule around the tube. The movement of the body with the collar may be substantially prevented in the first direction at the first position by applying a force in a second direction. The collar may be guided to a second position. The collar may move the body to the second position by applying a force in the first direction greater than the force in the second direction. The insert of the body may move towards the head of the mandrel compressing the compressible material expanding a wall of the tube outward into grooves of the ferrule.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
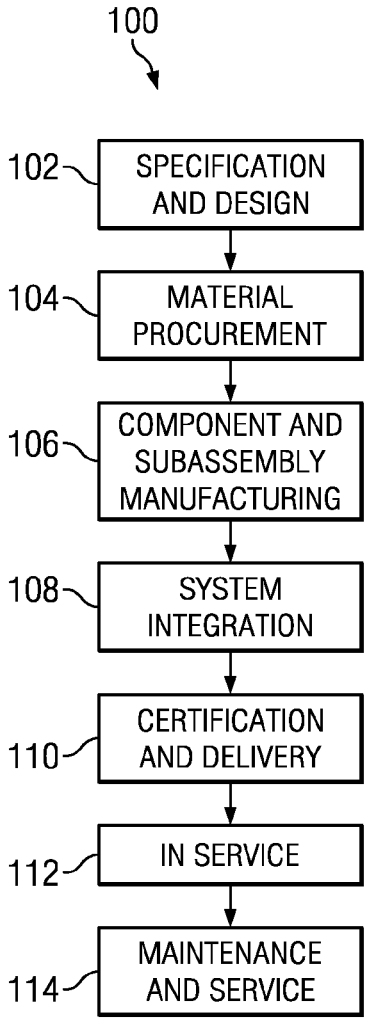
FIG. 1 is an illustration of an aircraft manufacturing and service method in accordance with an advantageous embodiment.
Figure 2:
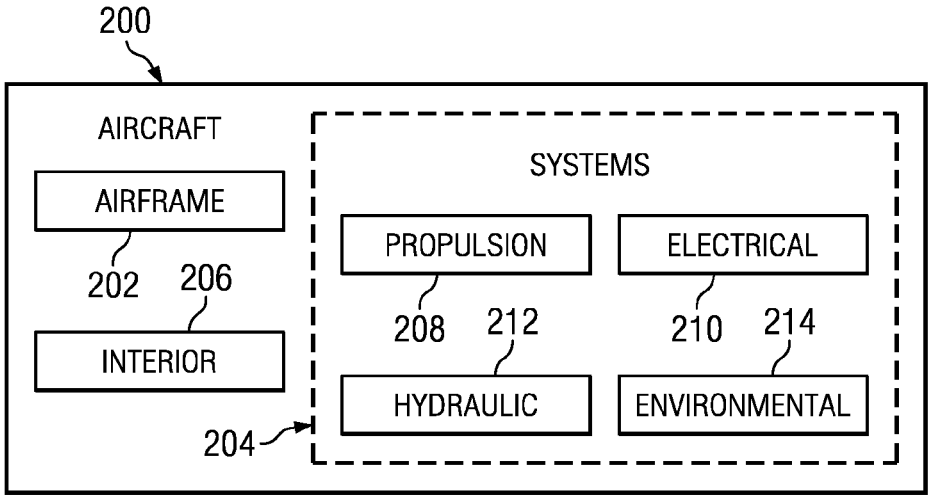
FIG. 2 is an illustration of an aircraft in which an advantageous embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, an illustration of an aircraft manufacturing and service method is depicted in accordance with an advantageous embodiment. During pre-production, aircraft manufacturing and service method 100 may include specification and design 102 of aircraft 200 in FIG. 2 and material procurement 104.

During production, component and subassembly manufacturing 106 and system integration 108 of aircraft 200 in FIG.

2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

With reference now to FIG. 2, an illustration of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of plurality of systems 204 include one or more of propulsion 208, electrical 210, hydraulic 212, and environmental 214. Any number of other systems may be included. Although an aerospace example is shown, different advantageous embodiments may be applied to other industries, such as the automotive industry.

Apparatus and methods embodied herein may be employed during at least one of the stages of aircraft manufacturing and service method 100 in FIG. 1. As used herein, the phrase "at least one of", when used with a list of items, means that different combinations of one or more of the listed items may be used and only one of each item in the list may be needed. For example, "at least one of item A, item B, and item C" may include, without limitation, item A or item A and item B. This example also may include item A, item B, and item C or item B and item C.

As one illustrative example, components or subassemblies produced in component and subassembly manufacturing 106 in FIG. 1 may be fabricated or manufactured in a manner similar to components or subassemblies produced while aircraft 200 is in service 112 in FIG. 1. As yet another example, a number of apparatus embodiments, method embodiments, or a combination thereof may be utilized during production stages, such as component and subassembly manufacturing 106 and system integration 108 in FIG. 1.

The different advantageous embodiments recognize and take into account a number of different considerations. For example, the different advantageous embodiments recognize and take into account that mandrels use two hydraulic cylinders to perform a swaging process. The different advantageous embodiments recognize and take into account that using two hydraulic cylinders may cause the swage machine to take up a large amount of space. A first hydraulic cylinder may be used to clamp a tube, while a second hydraulic cylinder may be used to form the tube. Using more than one hydraulic cylinder may also increase costs associated with buying and running more than one hydraulic cylinder.

The different advantageous embodiments provide a method and apparatus for forming materials that may comprise a body having a channel and an insert. The channel may extend to a first opening in the body and a second opening in the body. The apparatus may also comprise a mandrel disposed in the channel of the body and the insert of the body. The mandrel may have a shaft, a head on the shaft, and a compressible material disposed between the head and the insert of the body. The apparatus may also comprise a collar. The collar may have a diameter smaller than a diameter of the body. The apparatus may also comprise a biasing system configured to guide the collar in a first direction to a first position and then to a second position. The apparatus may further comprise a number of springs configured to apply force to the body in a second direction. The channel of the body may have a diameter that is configured to decrease in size. The mandrel may be configured to receive a tube from the head to the insert of the body. The first position may allow the collar to clamp the tube and a ferrule. The second position may allow the collar to compress the compressible material expanding a wall of the tube outward into grooves of the ferrule.

Figure 3:
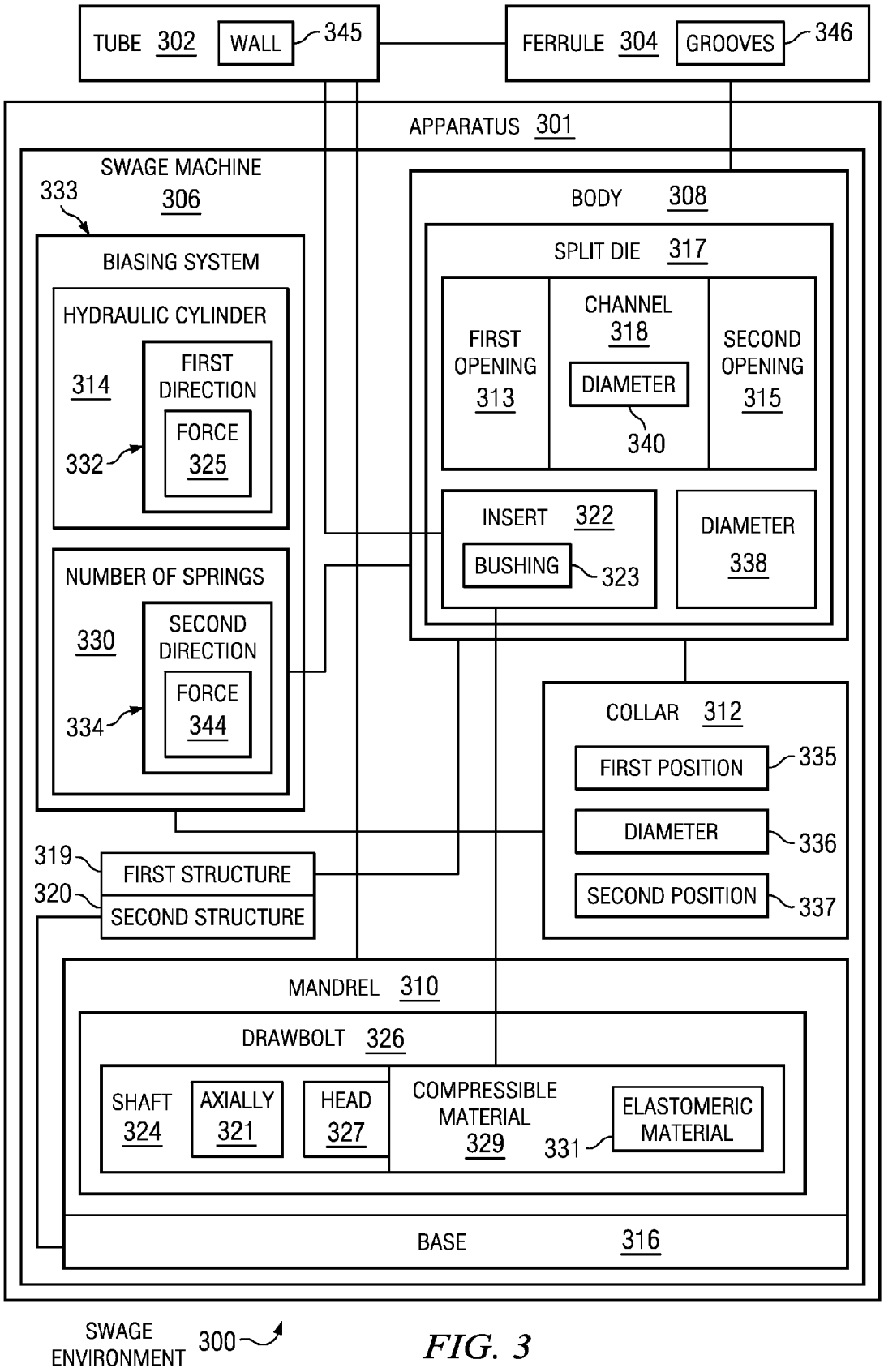
FIG. 3 is an illustration of a block diagram of a swage environment in which an advantageous embodiment may be implemented.

Turning to FIG. 3, a block diagram of a swage environment is depicted in accordance with an advantageous environment. Swage environment 300 may be utilized during component and subassembly manufacturing 106 and/or maintenance and service 114 of FIG. 1. Swage environment 300 may also be used in developing parts of airframe 202 of FIG. 2. Swage environment 300 may include apparatus 301, tube 302, and ferrule 304.

Apparatus 301 may be swage machine 306. Swage machine 306 may be a machine used to alter the dimensions of items, such as, but not limited to, tube 302 and/or any other type of hollow structure. Swage machine 306 may include body 308, mandrel 310, collar 312, hydraulic cylinder 314, and base 316.

Body 308 may be split die 317. Body 308 may be one single structure or may be multiple structures connected. In other advantageous embodiments, body 308 may be another type of die. Split die 317 may be a die made in one piece with channel 318 which allows size adjustment. Channel 318 may extend to first opening 313 and second opening 315. Split die 317 may be used to position and hold in place an item such as tube 302 and/or ferrule 304. Body 308 may be connected to base 316 directly, or through another structure or structures, such as first structure 319 and second structure 320. Split die 317 may be tapered. When forces are exerted against split die 317, channel 318 may decrease in diameter. Channel 318 may also be a cavity in one or more advantageous embodiments. Split die 317 may also include insert 322. Insert 322 may be disposed around mandrel 310. Insert 322 may be a cylindrical lining designed to constrict and restrain motion of mechanical parts, such as, but not limited to, a bushing 323. Insert 322 of split die 317 may move axially 321 along shaft 324 of mandrel 310. Axially 321 may also be the same direction as first direction 332.

Mandrel 310 may be an elongated structure such as, but not limited to, drawbolt 326. Mandrel 310 may be an object used to shape machined work. Mandrel 310 may be inserted in, or next to, an item to be machined or bent in a certain pattern. Mandrel 310 may include shaft 324, head 327 located on shaft 324, and compressible material 329 disposed between head 327 and insert 322 of split die 317. Compressible material 329 may be any material which when compressed exerts an outward force against areas of least resistance. An area of least resistance may be an area which does not have a force applied, or one that has a lesser force applied. Compressible material 329 may have internal compression. Compressible material 329 may be, for example, elastomeric material 331.

Collar 312 may be a ring surrounding split die 317, first structure 319, and/or second structure 320. In different advantageous embodiments, collar 312 may surround different parts of apparatus 301 during different parts of the swaging process. During first position 335, collar 312 may be surrounding split die 317 to compress split die 317. When split die 317 is compressed, channel 318 may decrease in diameter.

When channel 318 decreases in diameter, split die 317 may operate as a clamp keeping tube 302 and ferrule 304 in position in channel 318. Collar 312 may be guided in first direction 332 by hydraulic cylinder 314. Hydraulic cylinder 314 may be part of biasing system 333. Biasing system 333 may move collar 312 of swage machine 306 in first direction 332. Biasing system 333 may be any type of system which is capable of moving another item. Collar 312 may have diameter 336 smaller than diameter 338 of split die 317. As collar 312 moves in first direction 332 to reach first position 335 and begins to surround split die 317, collar 312 applies pressure to split die 317. The pressure against split die 317 may be applied axially inward towards channel 318 of split die 317, decreasing diameter 340 of channel 318 of split die 317. When diameter 340 of channel 318 decreases, split die 317 may clamp and maintain the position of, tube 302 and ferrule 304 relative to split die 317.

Base 316 may be connected to another structure for housing apparatus 301, such as, but not limited to, a workshop bench, a moveable cart, and/or a floor. In one or more advantageous embodiments, base 316 may include number of springs 330. Number of springs 330, without limitation, may be elastic devices used to store mechanical energy. Number of springs 330 may apply force 344 in second direction 334 by pulling on first structure 319, second structure 320, and/or split die 317. Force 344 in second direction 334 keeps split die 317 from substantially moving in first direction 332. Force 344 allows for some movement and allows for collar 312 to fully clamp split die 317 around tube 302 and ferrule 304.

Number of springs 330 may be connected to first structure 319, second structure 320, and/or split die 317. Number of springs 330 may also be part of biasing system 333. Number of springs 330 allows tube 302 and ferrule 304 to keep from moving in first direction 332 when not in a fully clamped position. Fully clamped may be enough pressure to hold tube 302 and ferrule 304 in position with split die 317 so that tube 302 and ferrule 304 move with split die 317 when pressure is applied from mandrel 310. When collar 312 first makes contact with split die 317, split die 317 may begin to clamp around tube 302 and ferrule 304. Number of springs 330 may apply a desired pressure to allow collar 312 to surround split die 317 to fully clamp split die 317 around tube 302 and ferrule 304. Once collar 312 has compressed split die 317 enough to fully clamp tube 302 and ferrule 304, collar 312 may be making enough contact with split die 317 to apply enough pressure to split die 317 in first direction 332 to move split die 317 in first direction 332 over the pressure applied by number of springs 330. When collar 312 forces split die 317 in first direction 332 by applying force 325 in first direction 332, insert 322 of split die 317 may move along shaft 324 of mandrel 310. Collar 312 may move split die 317 to second position 337. During the movement from first position 335 to second position 337, insert 322 of split die 317 approaches head 327 of mandrel 310 and compressible material 329 may be compressed and expand against tube 302, the area of least resistance. Tube 302 may expand as a result of the force received from compressible material 329. As tube 302 expands, wall 345 of tube 302 may be forced into grooves 346 of ferrule 304. Wall 345 of tube 302 may take the shape of grooves 346 of ferrule 304 in response to being forced into grooves 346 of ferrule 304.

The illustration of swage environment 300 in FIG. 3 is not meant to imply physical or architectural limitations to the manner in which different advantageous embodiments may be implemented. Other components in addition to, and/or in place of, the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, biasing system 333 may be located on swage machine 306. Likewise, collar 312 may be located and separate from swage machine 306. Split die 317 may be one or more components. More structures than first structure 319 and second structure 320 may exist in swage machine 306. For example, in addition to first structure 319 and second structure 320, there may be a third structure between second structure 320 and base 316. First structure 319, second structure 320, the third structure, or any number of other structures may be used to provide structure and form the apparatus 301 allowing for example, without limitation, a longer or short mandrel 310. Biasing system 333 may be separated into separate components. For example, number of springs 330 may be separate from hydraulic cylinder 314. Number of springs 330 may be located in base 316.

Figure 4:
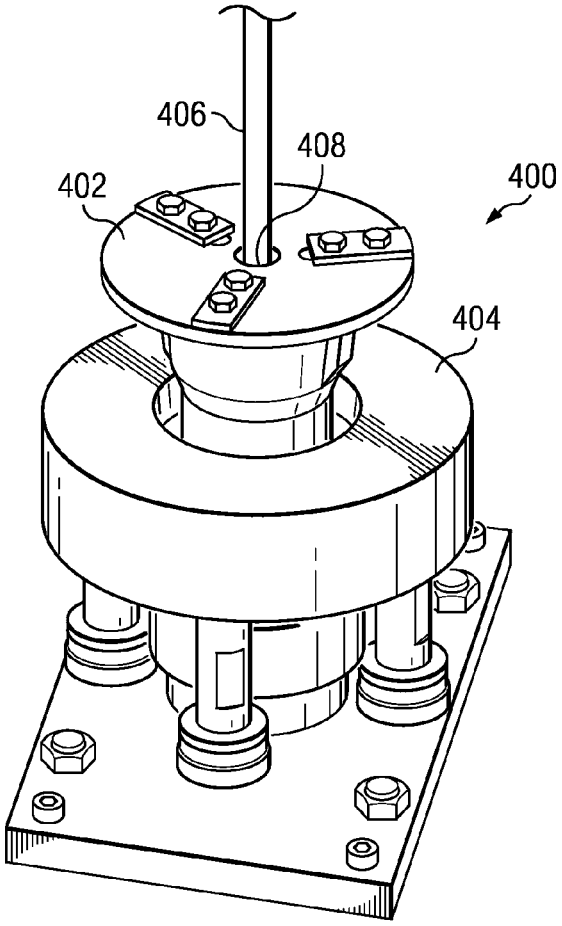
FIG. 4 is an illustration of a swage machine in an unclamped position in which an advantageous embodiment may be implemented.

Turning to FIG. 4, a swage machine in an unclamped position is depicted in accordance with an advantageous embodiment. Swage machine 400 may be one example of one implementation of swage machine 306 of FIG. 3. Swage machine 400 includes split die 402 and collar 404. Tube 406 is disposed in channel 408 of split die 402. Swage machine 400 may be one example of one implementation of swage machine 306 of FIG. 3. Split die 402 may be one example of one implementation of split die 317 of FIG. 3.

Figure 5:
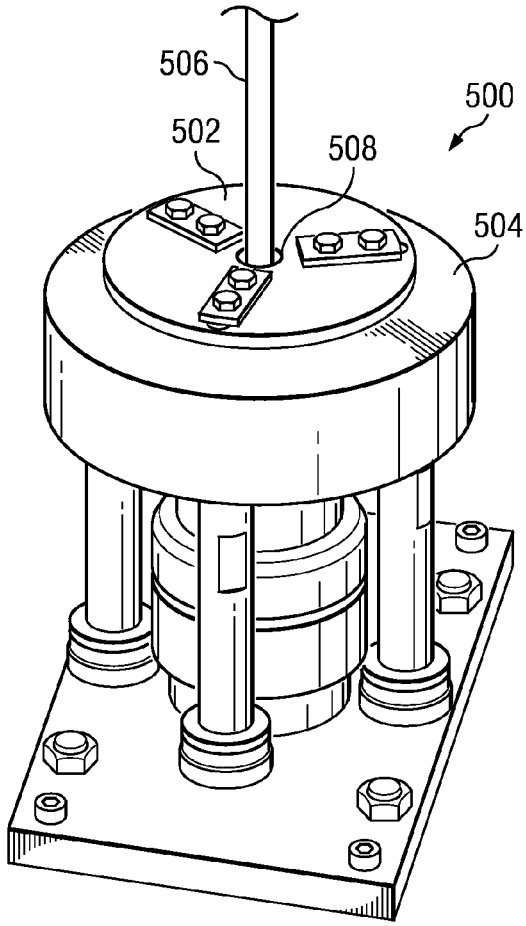
FIG. 5 is an illustration of a swage machine in a clamped position in which an advantageous embodiment may be implemented.

Turning to FIG. 5, a swage machine in a clamped position is depicted in accordance with an advantageous embodiment. Swage machine 500 may be one example of one implementation of swage machine 306 of FIG. 3. Swage machine 500 includes split die 502 and collar 504. Tube 506 is disposed in channel 508 of split die 502. Split die 502 may be one example of one implementation of split die 317 of FIG. 3.

Figure 6:
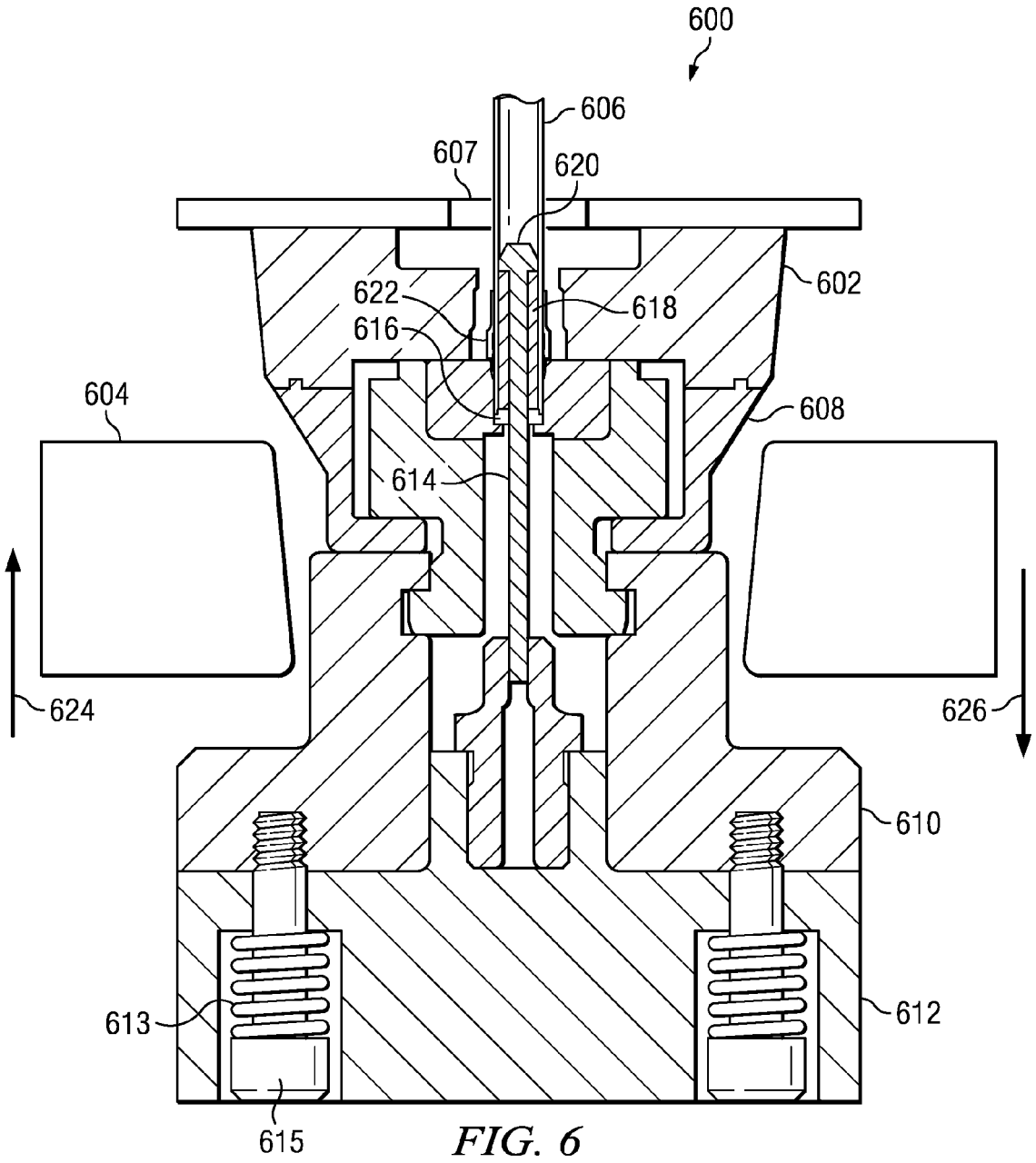
FIG. 6 is an illustration of a swage machine in an unclamped position in which an advantageous embodiment may be implemented.

Turning to FIG. 6, a swage machine in an unclamped position is depicted in accordance with an advantageous embodiment. Swage machine 600 may be one example of one implementation of swage machine 306 of FIG. 3. Swage machine 600 may include split die 602 and collar 604. Tube 606 may be disposed in channel 607 of split die 602. Swage machine 600 may be one example of one implementation of swage machine 306 of FIG. 3. Split die 602 may be one example of one implementation of split die 317 of FIG. 3. Swage machine 600 may also include first structure 608 connected to split die 602 and second structure 610. Second structure 610 may be connected to first structure 608 and base 612. Collar 604 may be disposed around first structure 608 and second structure 610 in the unclamped position. Base 612 may include springs 613 surrounding bolts 615. Tube 606 may be placed over a portion of mandrel 614 until tube 606 reaches insert 616. Compressible material 618 may be disposed between insert 616 and head 620 of mandrel 614. Ferrule 622 may be placed around the portion of tube 606 that is around compressible material 618.

In this advantageous embodiment, second structure 610 may be substantially flush against base 612. A force in first direction 624 may not be greater than a force in second direction 626 caused by springs 613. First direction 624 may be one example of one implementation of first direction 332 of FIG. 3. Second direction 626 may be one example of one implementation of Second direction 334 of FIG. 3.

Figure 7:
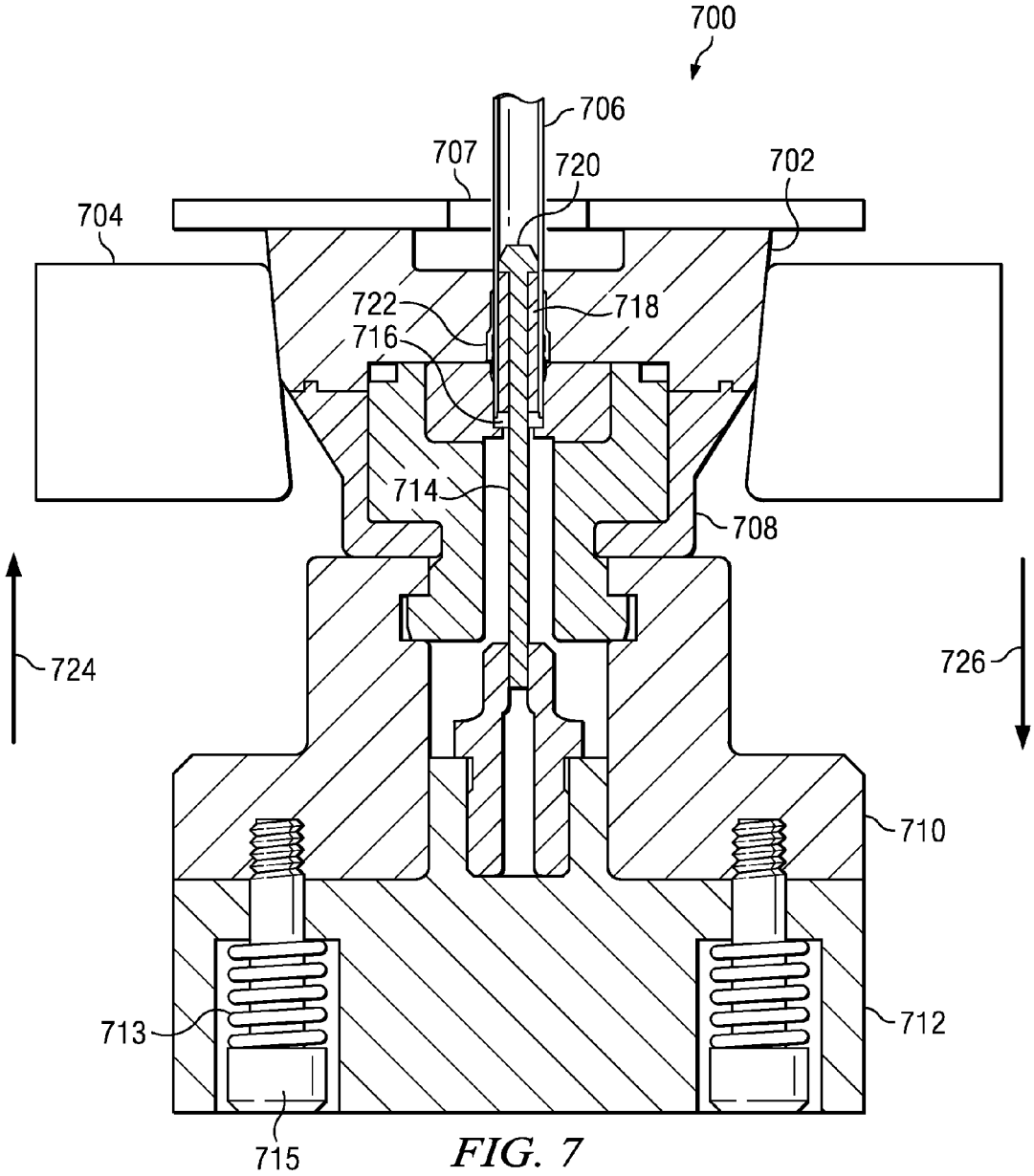
FIG. 7 is an illustration of a swage machine in a clamped position in which an advantageous embodiment may be implemented.

Turning to FIG. 7, a swage machine in a clamped position is depicted in accordance with an advantageous embodiment. Swage machine 700 may be one example of one implementation of swage machine 306 of FIG. 3. Swage machine 700 may include split die 702 and collar 704. Tube 706 may be disposed in channel 707 of split die 702. Split die 702 may be one example of one implementation of split die 317 of FIG. 3. Swage machine 700 may also include first structure 708 connected to split die 702 and second structure 710. Second structure 710 may be connected to first structure 708 and base 712. Collar 704 may be disposed around split die 702 and first structure 708 in the clamped position. Base 712 may include springs 713 surrounding bolts 715. Tube 706 may be placed over a portion of mandrel 714 until tube 706 reaches insert 716. Compressible material 718 may be disposed between insert 716 and head 720 of mandrel 714. Ferrule 722 may be placed around the portion of tube 706 that is around compressible material 718.

In this advantageous embodiment, second structure 710 may be substantially flush against base 712. Collar 704 may be in a first position, such as first position 335 of FIG. 3. A force in first direction 724 may not be greater than a force in second direction 726 caused by springs 713. First direction 724 may be one example of one implementation of first direction 332 of FIG. 3. Second direction 726 may be one example of one implementation of Second direction 334 of FIG. 3.

Figure 8:
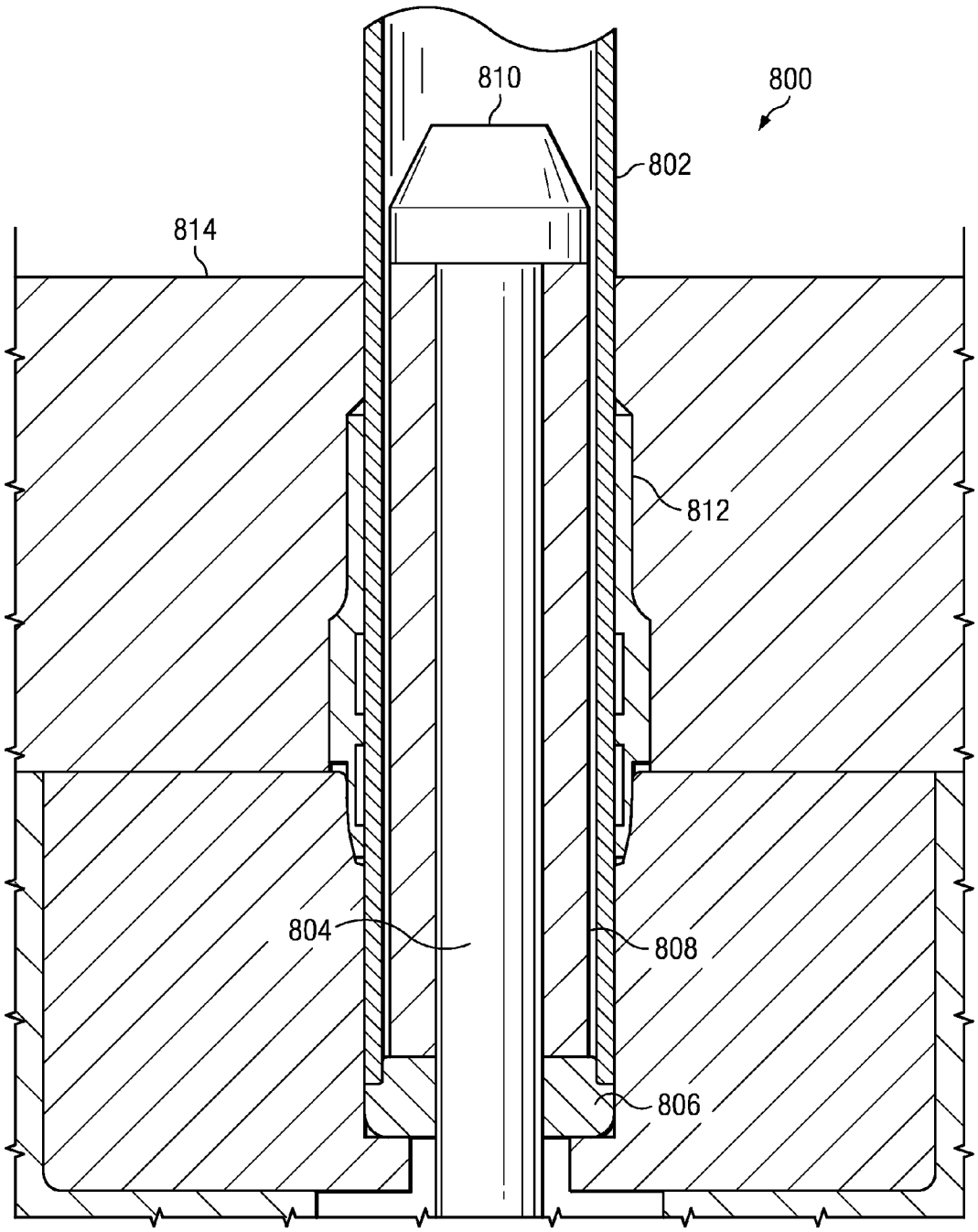
FIG. 8 is an illustration of a section of a mandrel with a compressible material in a clamped position in which an advantageous embodiment may be implemented.

Turning to FIG. 8, a section of a mandrel with a compressible material in a clamped position is depicted in accordance with an advantageous embodiment. Tube 802 may be located over a portion of mandrel 804 until tube 802 reaches insert 806. Tube 802 may be one example of one implementation of tube 302 of FIG. 3. Compressible material 808 may be disposed between insert 806 and head 810 of mandrel 804. Ferrule 812 may be around the portion of tube 802 that is around compressible material 808. Split die 814 may be clamped around ferrule 812 and tube 802 holding ferrule 812 and tube 802 in position. Split die 814 may be one example of one implementation of split die 317 of FIG. 3.

Figure 9:
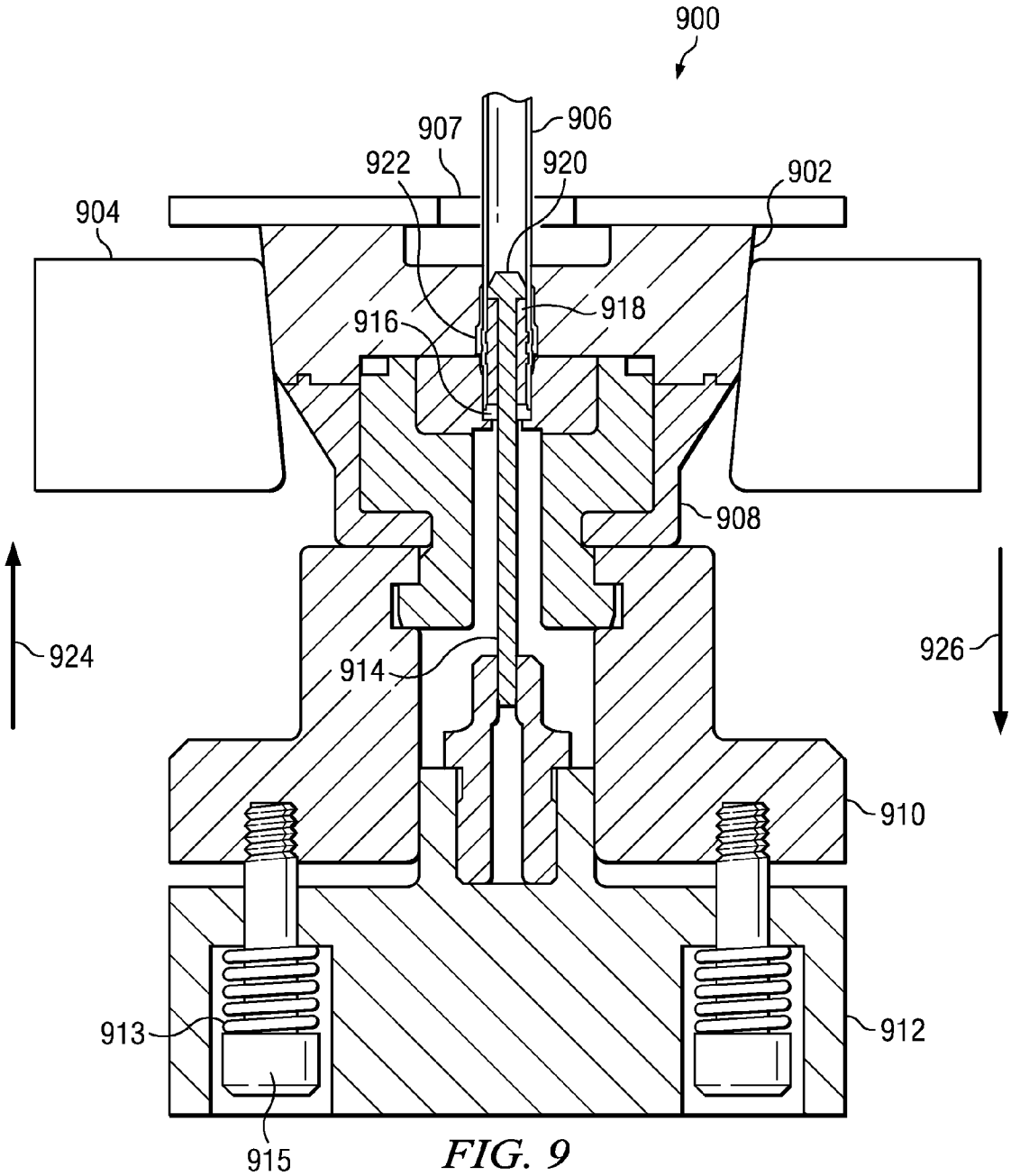
FIG. 9 is an illustration of a swage machine in a clamped position and pulled in which an advantageous embodiment may be implemented.

Turning to FIG. 9, a swage machine in a clamped position and pulled is depicted in accordance with an advantageous embodiment. Swage machine 900 may be one example of one implementation of swage machine 306 of FIG. 3. Swage machine 900 may include split die 902 and collar 904. Tube 906 may be disposed in channel 907 of split die 902. Split die 902 may be one example of one implementation of split die 317 of FIG. 3. Swage machine 900 may also include first structure 908 connected to split die 902 and second structure 910. Second structure 910 may be connected to first structure 908 and base 912. Collar 904 may be disposed around split die 902 and first structure 908 in the clamped position. Base 912 may include springs 913 surrounding bolts 915. Tube 906 may be placed over a portion of mandrel 914 until tube 906 reaches insert 916. Compressible material 918 may be disposed between insert 916 and head 920 of mandrel 914. Ferrule 922 may be placed around the portion of tube 906 that is around compressible material 918. Collar 904 may guide split die 902 away from base 912. As split die 902 is moved away from base 912, insert 916 may be moved closer to head 920, compressing compressible material 918.

In this advantageous embodiment, second structure 910 may be separated from base 912. Collar 904 may be in a second position, such as second position 337 of FIG. 3. A force in first direction 924 may be greater than a force in second direction caused by springs 913. First direction 924 may be one example of one implementation of first direction 332 of FIG. 3. Second direction 926 may be one example of one implementation of Second direction 334 of FIG. 3.

Figure 10:
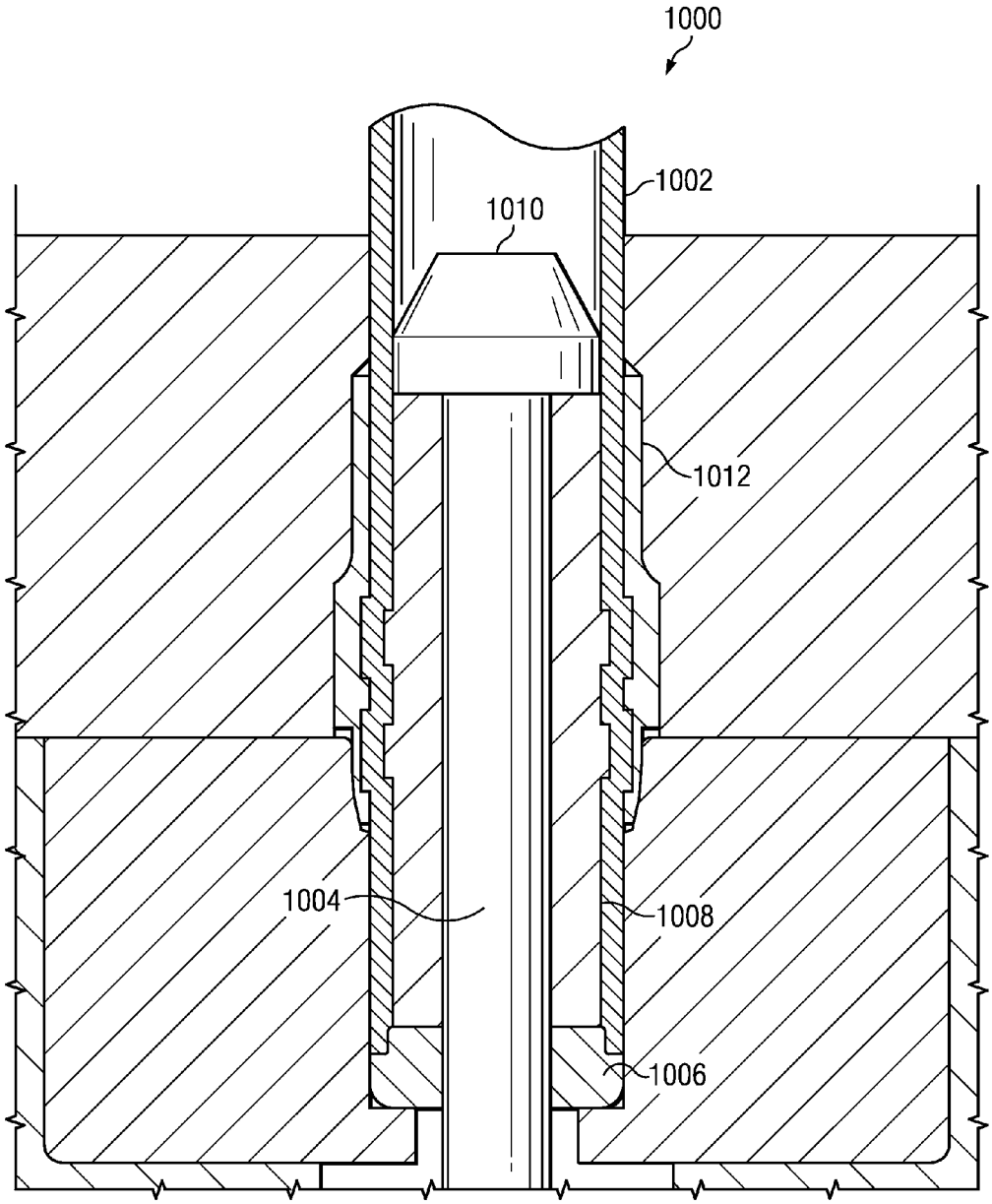
FIG. 10 is an illustration of a section of a mandrel after compression in which an advantageous embodiment may be implemented.

Turning to FIG. 10, a section of a mandrel after compression is depicted in accordance with an advantageous embodiment. Tube 1002 may be located over a portion of mandrel 1004 until tube 1002 reaches insert 1006. Tube 1002 may be one example of one implementation of tube 302 of FIG. 3. Compressible material 1008 may be disposed between insert 1006 and head 1010 of mandrel 1004. Ferrule 1012 may be around the portion of tube 1002 that is around compressible material 1008. Once compressible material has been compressed, tube 1002 may take substantially the shape of ferrule 1012. Additionally, ferrule 1012 may be attached to tube 1002.

Figure 11:
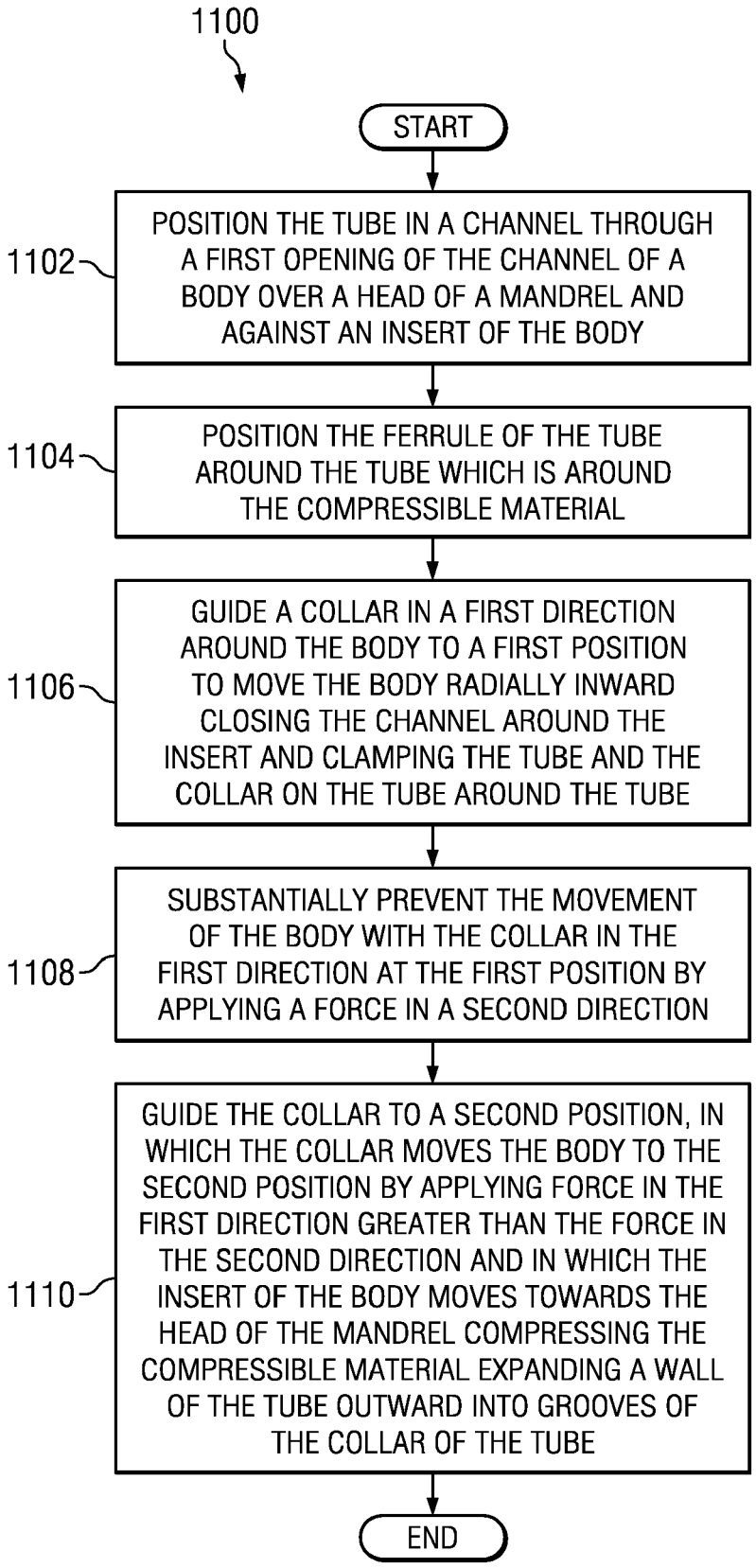
FIG. 11 is an illustration of a flowchart of a process for forming a tube and a ferrule in accordance with an advantageous embodiment.

FIG. 11 is an illustration of a flowchart of a process for forming a tube and a ferrule in accordance with an advantageous embodiment. The process is generally designated by reference number 1100, and may be implemented in an environment, such as swage environment 300 illustrated in FIG. 3.

The process may begin by positioning the tube 302 in a channel 318 through a first opening 313 of the channel 318 of a body 308 over a head 327 of a mandrel 310 and against an insert 322 of the body 308 (operation 1102). The tube 302 is placed in the channel 318 until it rests against the insert 322. The body 308 may be, but not limited to, a die, a split die 317, and/or a die combined with other structures, in one or more advantageous embodiments. A compressible material 329 may be disposed between the head 327 of the mandrel 310 and the insert 322 of the body 308. The compressible material 329 may be an elastomeric material 331. The ferrule 304 is positioned around the tube 302 which is around the compressible material 329 (operation 1104). A collar 312 may be guided in a first direction 332 around the body 308 to a first position 335 to move the body 308 radially inward closing the channel 318 around the insert 322 and clamping the ferrule 304 around the tube 302 (operation 1106). The movement of the body 308 with the collar 312 may be substantially prevented in the first direction 332 at the first position 335 by applying a force 344 in a second direction 334 (operation 1108). The force 344 in the second direction 334 may keep the body 308 from substantially moving in the first direction 332 which allows the collar 312 to move more onto the body 308 allowing the body 308 to move radially inward and substantially fully close the channel 318 of the body 308 and substantially clamp around the tube 302 and the ferrule 304. The collar 312 may be guided to a second position 337 (operation 1110). The collar 312 may move the body 308 to the second position 337 by applying a force 325 in the first direction 332 greater than the force 344 in the second direction 334. The collar 312 moving the body 308 to the second position 337 may cause the insert 322 of the body 308 may move towards the head 327 of the mandrel 310 compressing the compressible material 329 expanding a wall 345 of the tube 302 outward into grooves 346 of the ferrule 304.

The flowcharts and block diagrams in the different depicted embodiments illustrate the architecture, functionality, and operation of some possible implementations of apparatus and methods in different advantageous embodiments. In this regard, each block in the flowcharts or block diagrams may represent a module, segment, function, and/or a portion of an operation or step. In some alternative implementations, the function or functions noted in the blocks may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

The different advantageous embodiments provide a method and apparatus for forming materials may comprise a body having a channel and an insert. The channel may extend to a first opening in the body and a second opening in the body. The apparatus may also comprise a mandrel disposed in the channel of the body and the insert of the body. The mandrel may have a shaft, a head on the shaft, and a compressible material disposed between the head and the insert of the body. The apparatus may also comprise a collar. The collar may have a diameter smaller than a diameter of the body. The apparatus may also comprise a biasing system configured to guide the collar in a first direction to a first position and then to a second position. The apparatus may further comprise a number of springs configured to apply force to the body in a second direction. The channel of the body may have a diameter that is configured to decrease in size. The mandrel may be configured to receive a tube from the head to the insert of the body. The first position may allow the collar to clamp the tube and a ferrule. The second position may allow the collar to compress the compressible material expanding a wall of the tube outward into grooves of the ferrule.

The different advantageous embodiments recognize that current swage machines use two hydraulic cylinders. One cylinder to clamp and one cylinder to form the tubing. Because the different advantageous embodiments may use springs to apply a downward force to the split die, only one hydraulic cylinder is used. Additionally, the use of one cylinder requires less space and costs.

Although the different advantageous embodiments have been described with respect to parts used in an aircraft, other advantageous embodiments may be applied to parts for other types of vehicles or structures. For example, without limitation, other advantageous embodiments may be applied to other vehicles or structures which have a need for swaging.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand.

What is claimed is:

1. An apparatus, the apparatus comprising:

a body having a channel and an insert, in which the channel extends to a first opening in the body and a second opening in the body, and in which the channel of the body has a diameter that is configured to decrease in size;

a mandrel disposed in the channel of the body and the insert of the body, in which the mandrel has a shaft, a head on the shaft, and a compressible material disposed between the head and the insert of the body, and in which the mandrel is configured to receive a tube from the head to the insert of the body;

a collar, in which the collar has a diameter smaller than a diameter of the body;

a biasing system configured to guide the collar in a first direction to a first position and then to a second position and configured to apply force to the body in a second direction, in which in the first position the body clamps the tube and a ferrule, and in which in the second position the body compresses the compressible material expanding a wall of the tube outward into the ferrule.

2. The apparatus of claim 1, wherein the biasing system comprises a hydraulic cylinder and a number of springs, in which the hydraulic cylinder guides the collar in the first direction and the number of springs applies force to the body in the second direction.

3. The apparatus of claim 2, wherein the number of springs are configured to apply force during the first position preventing the body from moving substantially in the first direction and allowing the collar to substantially fully close the channel of the body and substantially clamp around the tube and the ferrule.

4. The apparatus of claim 2, wherein the number of springs are configured to apply force between the first position and the second position to allow the body to move with the collar in the first direction moving the tube in the first direction and compressing the compressible material.

5. The apparatus of claim 1, wherein compressing the compressible material comprises the insert of the body configured to move in a first direction towards the head of the mandrel in which the head of the mandrel remains stationary.

6. The apparatus of claim 1, wherein the compressible material is elastomeric.

7. The apparatus of claim 1, wherein the shaft is axial.

8. The apparatus of claim 1, wherein the collar is a closing ring.

9. The apparatus of claim 1, wherein the body is a split die.

10. The apparatus of claim 1, wherein the insert is a bushing.

11. The apparatus of claim 1, wherein the ferrule has grooves, and wherein the compressible material expanding the wall of the tube outward into the ferrule further comprises expanding the wall of the tube into the grooves of the ferrule.

12. An apparatus, the apparatus comprising:

a split die having a channel and a bushing, in which the channel extends to a first opening in the split die and a second opening in the split die and a bushing, and in which the channel of the split die has a diameter that is configured to decrease in size;

a mandrel disposed in the channel of the split die and the bushing of the split die, in which the mandrel has a shaft, a head on the shaft, and a compressible material disposed between the head and the bushing of the split die, in which the mandrel is configured to receive a tube from the head to the bushing of the split die, and in which the shaft is axial, and in which the compressible material is elastomeric;

a closing ring, in which the closing ring has a diameter smaller than a diameter of the split die;

a hydraulic cylinder configured to guide the closing ring in a first direction to a first position and then to a second position, in which in the first position the split die clamps the tube and a ferrule with grooves, and in which in the second position the split die compresses the compressible material expanding a wall of the tube outward into the grooves of the ferrule; and a number of springs configured to apply force to the split die in a second direction, in which the number of springs are configured to apply force during the first position preventing the split die from moving substantially in the first direction and allowing the closing ring to substantially fully close the channel of the split die and substantially clamp around the tube and the ferrule, in which the number of springs are configured to apply force between the first position and the second position to allow the split die to move with the closing ring in the first direction moving the tube in the first direction and compressing the compressible material, and in which compressing the compressible material comprises the bushing of the split die configured to move in a first direction towards the head of the mandrel in which the head of the mandrel remains stationary.

13. A method for forming a tube and a ferrule, the method comprising:

positioning the tube in a channel through a first opening of the channel of a body over a head of a mandrel and against an insert of the body, in which a compressible material is disposed between the head of the mandrel and the insert of the body;

positioning the ferrule around the tube which is around the compressible material;

moving the body radially inward closing the channel around the insert and clamping the tube and the ferrule around the tube;

substantially preventing the movement of the body with a collar in a first direction at a first position; and moving the body to a second position by applying a force in the first direction greater than a force in a second direction, and in which the insert of the body moves towards the head of the mandrel compressing the compressible material expanding a wall of the tube outward into the ferrule.

14. The method of claim 13, wherein moving the body radially inward further comprises guiding the collar in the first direction around the body to the first position.

15. The method of claim 13, wherein substantially preventing the movement of the body with the collar in the first direction at the first position further comprises applying a force in the second direction.

16. The method of claim 13, wherein moving the body to the second position by applying the force in the first direction greater than the force in the second direction further comprises guiding the collar to the second position.

17. The method of claim 13, wherein applying the force in the first direction and the force in the second direction is performed by a biasing system.

18. The method of claim 17, wherein the biasing system comprises a hydraulic cylinder applying the force in the first direction.

19. The method of claim 17, wherein the biasing system comprises a number of springs applying the force in the second direction.

20. The method of claim 18, further comprising guiding, by the hydraulic cylinder, the collar to a second position, in response to the collar substantially fully closing the channel of the body which substantially fully clamps the tube and the ferrule increasing the force in the first direction applied to the body to be greater than the force in the second direction allowing the body to move with the collar in the first direction.

21. The method of claim 13, wherein substantially preventing the movement of the body with the collar in the first direction at the first position by applying a force in a second direction further comprises applying the force in the second direction allowing the collar to move onto the body to fully clamp the tube and the ferrule.

22. The method of claim 13, wherein the compressible material is elastomeric.

23. The method of claim 13, wherein the insert is a bushing.

24. The method of claim 13, wherein the collar is a closing ring.

25. The method of claim 13, wherein the body is a split die.

26. The method of claim 13, wherein the ferrule has grooves, and wherein the compressible material expanding the wall of the tube outward into the ferrule further comprises expanding the wall of the tube into the grooves of the ferrule.

27. A method for forming a tube and a ferrule, the method comprising:

positioning the tube in a channel through a first opening of the channel of a split die over a head of a mandrel and against a bushing of the split die, in which a compressible material is disposed between the head of the mandrel and the bushing of the split die, and in which the compressible material is elastomeric;

positioning the ferrule around the tube which is around the compressible material;

guiding a closing ring in a first direction around the body to a first position to move the split die radially inward closing the channel around the bushing and clamping the tube and the ferrule around the tube;

substantially preventing the movement of the split die with the closing ring in the first direction at the first position by applying, by a number of springs, a force in a second direction allowing the closing ring to move onto the split die to substantially fully close the channel of the body which substantially fully clamps the tube and the ferrule; and responsive to the collar substantially fully closing the channel of the split die which substantially fully clamps the tube and the ferrule increasing the force in the first direction applied to the split die to be greater than the force in the second direction, guiding, by a hydraulic cylinder, the closing ring to a second position, in which the collar moves the split die to the second position by applying a force in the first direction greater than the force in the second direction, and in which the bushing of the split die moves towards the head of the mandrel compressing the compressible material expanding a wall of the tube outward into grooves of the ferrule.

* * * * *